US005573099A

United States Patent [19]

Church et al.

[11] Patent Number: 5,573,099

[45] Date of Patent: Nov. 12, 1996

[54] APPARATUS AND METHOD FOR IDENTIFYING METALLIC TOKENS AND COINS

[75] Inventors: Donald W. Church; Ove K. Gashus, both of Halifax, Canada

[73] Assignee: J. J. Mackay Canada Limited, Canada

[21] Appl. No.: 371,997

[22] Filed: Jan. 12, 1995

[30] Foreign Application Priority Data

Jan. 14, 1994 [CA] Canada ..... 2113492

[51] Int. Cl.[6] ..... G07D 5/08

[52] U.S. Cl. ..... 194/317

[58] Field of Search ..... 194/317, 318, 194/319

[56] References Cited

U.S. PATENT DOCUMENTS

| | | | |
|---|---|---|---|
| 3,373,856 | 3/1968 | Kusters et al. . | |
| 3,941,989 | 3/1976 | McLaughlin et al. | 235/156 |
| 3,982,620 | 9/1976 | Kortenhaus . | |
| 4,249,648 | 2/1981 | Meyer | 194/102 |
| 4,264,963 | 4/1981 | Leach | 364/707 |
| 4,306,219 | 12/1981 | Main et al. | 340/825.54 |
| 4,317,180 | 2/1982 | Lies | 364/707 |
| 4,317,181 | 2/1982 | Teza et al. | 364/707 |
| 4,409,665 | 10/1983 | Tubbs | 364/707 |
| 4,432,447 | 2/1984 | Tanaka . | |
| 4,460,080 | 7/1984 | Howard . | |
| 4,474,281 | 10/1984 | Roberts et al. . | |
| 4,479,191 | 10/1984 | Nojima et al. | 364/707 |
| 4,483,431 | 11/1984 | Pratt . | |
| 4,742,903 | 5/1988 | Trummer | 194/317 |
| 4,749,074 | 6/1988 | Ueki et al. | 194/317 |
| 4,763,769 | 8/1988 | Levasseur | 194/217 |
| 4,809,838 | 3/1989 | Houserman | 194/317 |
| 4,823,928 | 4/1989 | Speas | 194/217 |
| 4,827,206 | 5/1989 | Speas | 323/299 |
| 4,845,484 | 7/1989 | Ellsberg | 340/825.35 |
| 4,848,556 | 7/1989 | Shah et al. | 194/212 |
| 4,851,987 | 7/1989 | Day | 364/200 |
| 4,872,149 | 10/1989 | Speas | 368/90 |
| 4,880,097 | 11/1989 | Speas | 194/239 |
| 4,895,238 | 1/1990 | Speas | 194/319 |
| 4,946,019 | 8/1990 | Yamashita | 194/318 |
| 4,951,799 | 8/1990 | Xai | 194/317 |
| 4,967,895 | 11/1990 | Speas | 194/200 |
| 4,976,630 | 12/1990 | Schuder et al. | 439/260 |
| 4,989,714 | 2/1991 | Abe | 194/317 |
| 5,060,777 | 10/1991 | Van Horn et al. | 194/317 |
| 5,076,414 | 12/1991 | Kimoto | 194/317 |
| 5,119,916 | 6/1992 | Carmen et al. | 194/210 |

FOREIGN PATENT DOCUMENTS

| | | | |
|---|---|---|---|
| 2804085A1 | 2/1977 | Germany | G07C 1/04 |
| 2750193C2 | 11/1977 | Germany | G07F 3/02 |
| 3034156 | 3/1982 | Germany . | |
| 1237579 | 12/1968 | United Kingdom | G07F 17/24 |
| 1283555 | 10/1969 | United Kingdom | G07C 1/02 |
| WO81/00778 | 3/1981 | WIPO | G07F 17/24 |
| 9117527 | 11/1991 | WIPO . | |

*Primary Examiner*—F. J. Bartuska

*Attorney, Agent, or Firm*—Hayes, Soloway, Hennessey, Grossman & Hage, P.C.

[57] ABSTRACT

A method for identifying metallic coins and tokens, comprising: applying an input signal to an ac-bridge; bringing a coin/token in the vicinity of one arm of the ac-bridge; sensing an output signal of the ac-bridge; and associating the output signal with presence of the coin/token in the vicinity of the arm of the ac-bridge.

14 Claims, 5 Drawing Sheets

APPARATUS AND METHOD FOR IDENTIFYING METALLIC TOKENS AND COINS

BACKGROUND OF THE INVENTION

1. Field of the Invention

The present invention relates to the sensing and identification of metal tokens or coins electronically. More particularly, it relates to method and apparatus for identifying a variety of currency coins of several countries with high reliability and without the need of reprogramming or readjustment. More particularly still, the apparatus is suitable for yielding unique digital codes each corresponding to a single coin or token sensed and identified by the present method.

2. Prior Art of the Invention

It is known to utilize size, shape and electrical properties of a coin for coin discrimination. For example, these characteristics affect the coupling between an excited coil and a detection coil in U.S. Pat. No. 3,373,856 granted Mar. 19, 1968 to Kusters et al. The induced voltage in the detection coil is rectified and the coin is accepted only if the rectified voltage lies between two preset levels.

In U.S. Pat. No. 4,432,447 granted Feb. 21, 1984 to Tanaka, essentially the same principle as above is utilised to sort coins. But, in addition, there is another coil (3) through which the coin passes, which coil forms the arm of an excited bridge circuit. The variable arm of the bridge is adjusted such that it is normally unbalanced, and is balanced only when the "true" coin is passing through the coil. The zero output of the bridge when balanced momentarily is the indication of the true coin. The circuit is thus tailored to discriminate between a true coin of a desired denomination and a particular coin similar in configuration to the desired coin.

U.S. Pat. No. 4,460,080 granted Jul. 17, 1984 to Howard, discloses coin validation apparatus utilising a coil formed in two halves, connected in series with one half on one side of the coin runway and the other half on the other side of the coin runway. Capacitors are connected to the coil to form a resonant tank circuit, and the effect of a coin on the inductance and loss factor of the coil is compared to reference values to determine coin validity.

U.S. Pat. 4,742,903 granted May 10, 1988 to Trummer, discloses several oscillator tank circuits having different natural frequencies ranging from 120 kHz to 247 kHz. The attenuators of the oscillator tank circuits are balanced by resistors, so that the high frequency voltage which the oscillator exhibits with each of the tank circuits have the same amplitude in the absence of a coin. The effect of the coin alloy on the low frequency test signal is greater, while the effect of the depth of embossing is smaller.

U.S. Pat. 4,895,238 granted Jan. 23, 1990, to Speas discloses a coin discriminator system for use in an electronic parking meter. A deposited coin is inserted in the electronic parking meter and a chute guides the deposited coin past an inductor. The deposited coin causes a momentary change in the value of inductance of the inductor. A phase lock loop electronic circuit has an input connected to the inductor and the phase lock loop electronic circuit. The correction signal compensates for the change in value of inductance of the inductor and has a wave shape unique to the deposited coin. A microprocessor receives the correction signal wave form for comparison to a plurality of predetermined wave shapes of a plurality of known coins to thereby identify the deposited coin. The plurality of predetermined wave shapes are stored in a memory connected to the microprocessor.

SUMMARY OF THE INVENTION

The present invention utilizes the sensitivity of an ac-bridge circuit, but one which is normally balanced and is unbalanced by the passage of a coin or token. The frequency at which the maximum bridge output occurs, and the value of that maximum, have been found to uniquely identify in excess of twenty different coins from several countries. On the other hand, a given frequency, the bridge, when unbalanced, provides a complex output voltage (including both amplitude and phase angle) which is a function of the conductivity and permeability as well as the size of the coin causing the unbalance.

Indeed, in its broadest aspect, the apparatus and method of the present invention are capable of identifying and discriminating several coins or tokens by sensing a single bridge parameter. For example, phase difference, frequency or output. However, it is preferred that at least two such parameters be used to identify tokens. For example, frequency and output level; phase difference and output level; or phase difference and frequency.

According to the preferred method aspect of the present invention, an input signal is applied to an ac-bridge, a coin or token is brought in the vicinity of one arm of the ac-bridge, an output signal of the ac-bridge is sensed, and the output signal is associated with presence of the coin or token in the vicinity of the arm of the bridge.

According to the preferred apparatus aspect of the present invention there is provided, a bridge for coin/token identification, comprising: two inductors of equal value and two impedances of equal value, one in each arm of the bridge; signal generating means for applying a predetermined frequency across an input of the bridge; and phase detection means at an output of the bridge.

In a narrower aspect, the phase detection means detects a predetermined phase shift between input and output of the bridge.

In a narrower aspect yet, the phase detection means controls the frequency of the signal generating means until the predetermined phase shift is detected, thereby detecting a maximum in bridge unbalance.

At maximum bridge unbalance, the predetermined phase shift is either 180 degrees or zero degrees.

In a further, narrower, aspect, an amplitude detection means is provided at the output of the bridge.

In yet another, narrower, aspect, the signal generating means applies a sequence of predetermined frequencies across the input of the bridge.

In the preferred aspect, the sequence of predetermined frequencies is a signal having continuously variable frequency between predetermined lower and upper frequencies.

In a more preferred aspect, the continuously variable frequency signal is repeated until a predetermined output is detected across the output of the bridge.

BRIEF DESCRIPTION OF THE DRAWINGS

The preferred embodiment of the present invention will now be described in detail in conjunction with the annexed drawings, in which.

DETAILED DESCRIPTION OF THE PREFERRED EMBODIMENT

Figure 1:
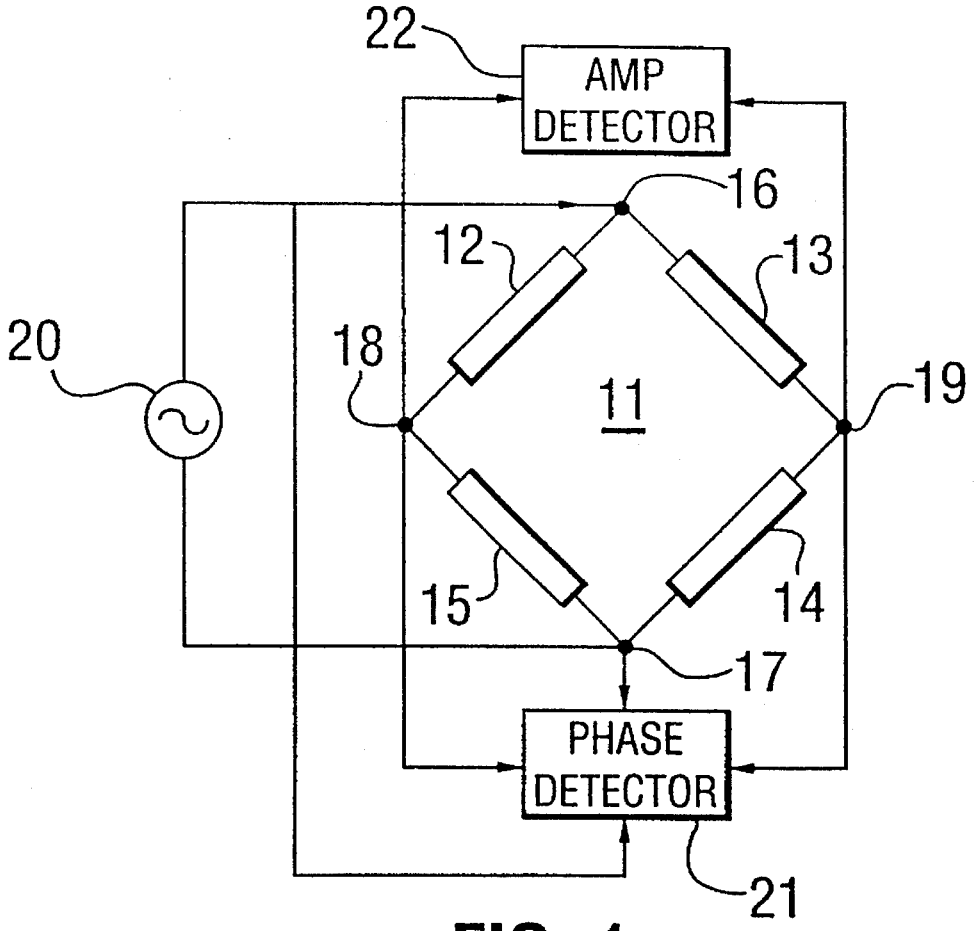
FIG. 1 is a block schematic of the apparatus for identifying metallic tokens and coins of the present invention.

Referring to FIG. 1, a general schematic of the apparatus of the present invention is shown. It comprises a normally balanced bridge 11 constituted by four impedances 12, 13, 14 and 15, and therefore, having two sets of diagonal nodes 16/17 and 18/19. A signal generator 20 is applied to the bridge 11 across the nodes 16/17, while a phase detector 21 is applied across the nodes 18/19. Also shown is an amplitude detector 22 across the nodes 18/19. For ease of phase detection, the phase detector 21 is shown having the signal from the generator 20 as input. In operation, the phase detector 21 compares the phase of the output signal at the nodes 18/19 to that at the (input) nodes 16/17 and indicates the phase difference detected, once the amplitude of the output signal at the nodes 18/19 is sufficient to enable such phase comparison; that is, once the bridge 11 is sufficiently unbalanced by the passage of a coin or token in the vicinity of one of the bridge 11 arms 12, 13, 14 or 15. It is, therefore, necessary that at least one of the bridge 11 impedances be of such nature as to change its impedance value as the coin or token is brought near it. The amplitude detector 22 detects the amplitude of the output signal at the nodes 18/19. Thus, both phase difference and amplitude are associated, and may both be used as two parameters unique to each member of a predetermined set of tokens. On the other hand, one may choose to associate the value of one of the two parameters, at a fixed value of the other parameter, the token identifying parameter. Moreover, the frequency of the signal applied by the generator 20 may be used as a third parameter for finer discrimination between tokens. Thus, if the amplitude is measured always at the point where the phase difference is 180° (this is the point of maximum bridge unbalance and, hence, maximum amplitude at the nodes 18/19), and is found to be the same for any two coins, then the two frequencies at which this occurs are used to distinguish one coin from the other. Accordingly, it is necessary that coins of different currency or denomination not be identical in all physical and compositional respects for the present invention to distinguish them.

Figure 2:
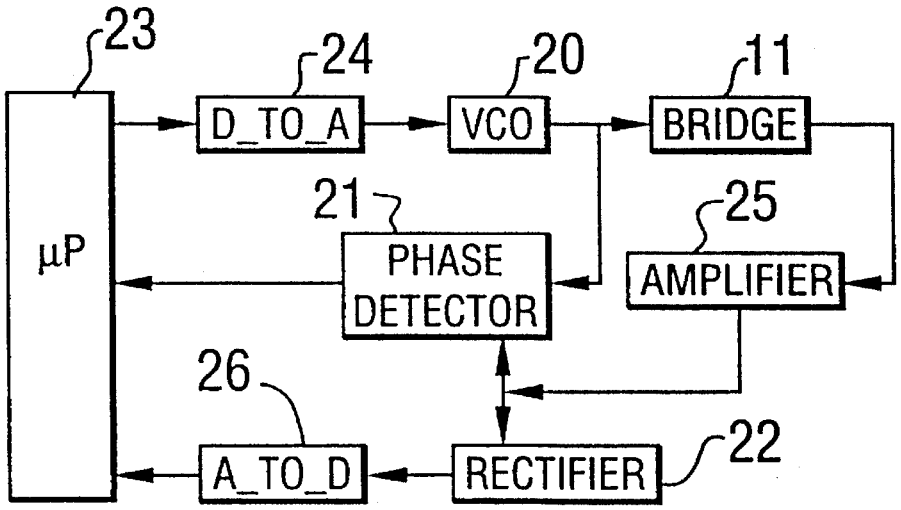
FIG. 2 is a more detailed block schematic of the apparatus shown in FIG. 1.

FIG. 2 of the drawings shows a block schematic, wherein a microprocessor 23 is utilised to perform central and monitoring functions of the generator/VCO 20 (voltage controlled oscillator), the phase detector 21, and the amplitude detector/rectifier 22. Thus, the processor 23 outputs a staircase signal which is converted in D/A converter 24 (digital-to-analog) to an analog voltage to cause the VCO to sweep its frequency range (approximately 100 to 250 kHz) and accordingly drive the bridge 11. The output of the bridge 11 is applied to a bridge amplifier 25 (in order not to load the bridge and upset its balance/unbalance conditions), the output of which is applied to the phase detector 21 and the rectifier 22, the output of which in turn is applied to an A/D converter 26 in order that the microprocessor 23 may associate the amplitudes and phases detected with the driving frequency, and thus identify the token causing the bridge 11 unbalance by comparing the parameter (or parameters) detected with that stored in its memory. An example of such a table of parameters stored in the memory for the amplitude and frequency at the point of 180° phase difference (between output and input of the bridge 11) is as follows:

| COIN (Country and Denomination) | AMPLITUDE (Relative Value in Hexadecimal Notation) | FREQUENCY (in KHz) |
|---|---|---|
| UK - 2p | 88 | 136.2 |
| CAN - 1c | 96 | 143.6 |
| US - 25c | B6 | 143.6 |
| US - 10c ('86) | DC | 150.9 |
| CHILE - 1 peso | A7 | 164.8 |
| UK - 50p | AB | 168.0 |
| YUG - 1 dinar | 9D | 171.3 |
| FRANCE - 20 ct | BA | 171.4 |
| FINLAND - 1mk | A9 | 178.2 |
| SPAIN - 5 ptas | AA | 178.2 |
| UK - 5 np | B0 | 181.2 |
| US - 5c ('89) | B2 | 181.2 |
| US - 5c ('62) | B4 | 181.2 |
| GER - 1 DM | B0 | 184.4 |
| GER - 50 pf | CE | 184.4 |
| CAN - $1 | 56 | 199.6 |
| CAN - 5c ('65) | 8F | 208.7 |
| CAN - 25c | 80 | 211.6 |
| CAN - 10c | AA | 228.6 |

Figure 3:
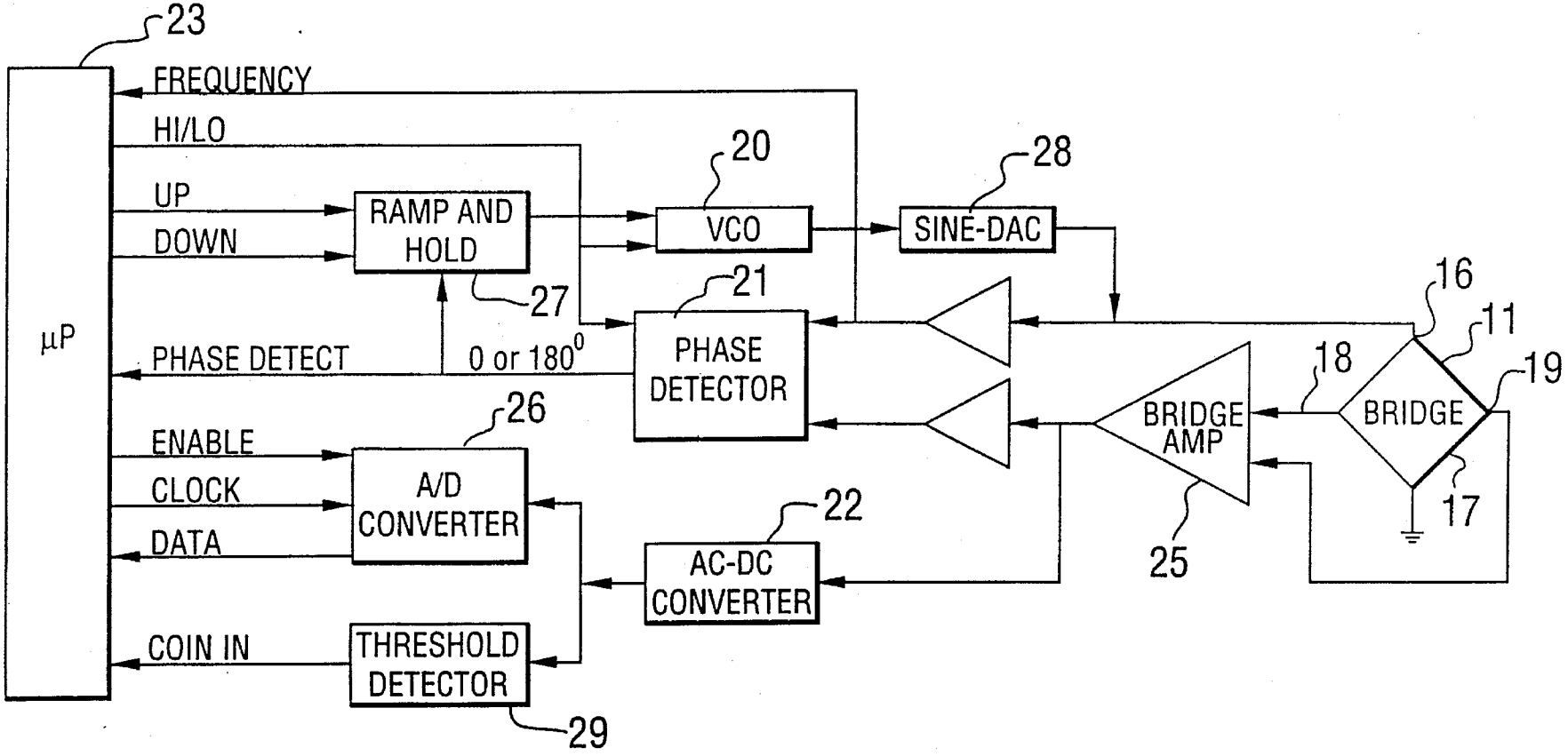
FIG. 3 is a block schematic showing in more detail the apparatus shown in FIG. 2.

FIG. 3 is a yet more detailed block schematic diagram of the apparatus. In it, the D/A converter 24 is replaced by Ramp-and-Hold Circuit 27 controlled by the microprocessor 23 to increase or decrease its output voltage in steps (ramps), thereby incrementally (or decrementally) controlling the VCO 20. The latter sweeps the frequency range up or down. The VCO 20 is followed by a digital-to-analog convertor SINE-DAC 28, the output of which drives the bridge 11 at the nodes 16/17. The output nodes 18/19 of the bridge 11 are connected to the bridge amplifier 25, the output of which is buffered before application to the phase detector 21. A phase difference between the signal at the nodes 18/19 and that at the nodes 16/17 of 180° (or 0° ) is signalled to the processor 23 and causes the Ramp-and-Hold Circuit 27 to hold its instantaneous voltage ramp, causing the VCO 20 to hold that particular frequency which corresponds to the 180° phase shift and also corresponds to the maximum unbalance of the bridge 11 and the maximum amplitude at the nodes 18/19. The maximum amplitude is rectified by the detector 22 and digitalized in the A/D convertor 26. The value of the amplitude is associated with the held frequency of the VCO 20 by the processor 23 and such combination is used by the processor 23 to locate it in the memory, thus identifying the coin as per the table shown above. Of course, failure to identify the particular combination of amplitude and frequency results in the coin being rejected as unacceptable. The microprocessor 23 is alerted to enable the A/D convertor 26 by a "coin in" signal once the signal from the rectifier 22 exceeds the threshold set at threshold detector 29.

Figure 4:
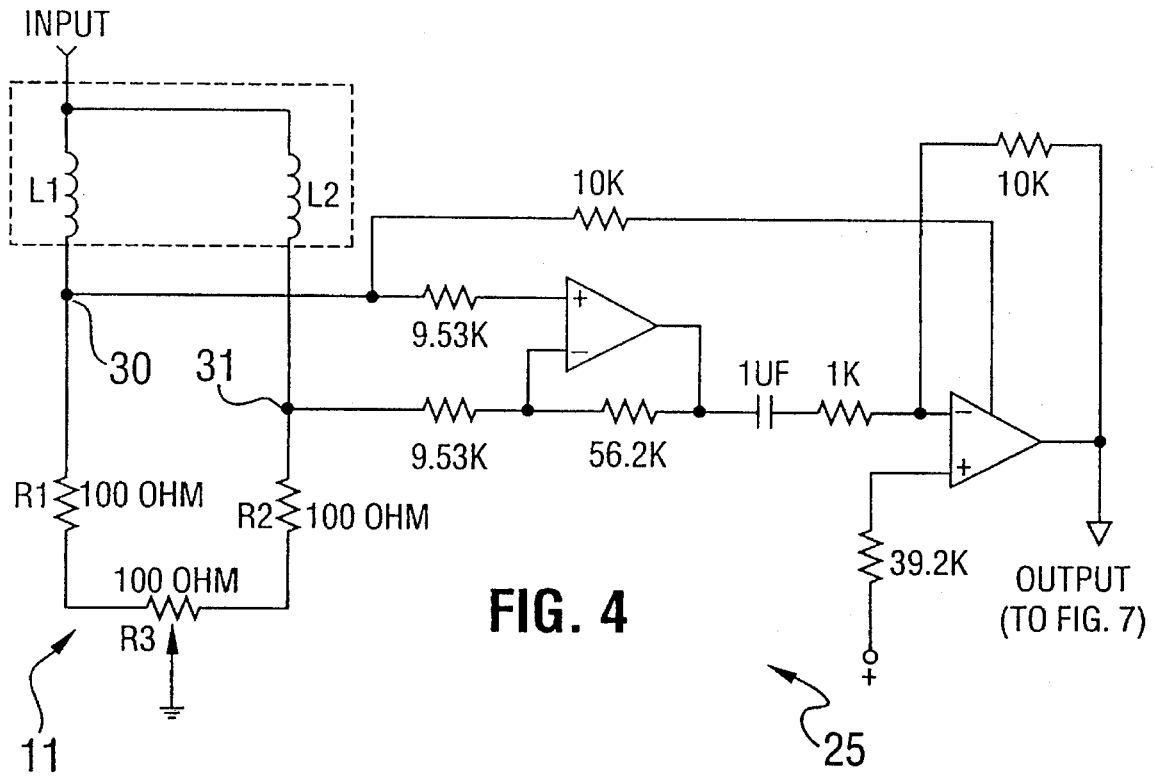
FIG. 4 is a circuit schematic of the bridge and bridge amplifier shown in FIG. 3.

FIG. 4 shows the bridge 11 circuit and bridge amplifier 25 components. The bridge 11 comprises two wire coils (inductors) L1 and L2, at the junction of which (INPUT) the input signal (generated by the VCO 20 and conditioned by the SINE-DAC 28) is applied. The remaining two bridge arms and resistors R1 and R2 and the respective sides of fine balancing potentiometer R3, which is used to compensate for slight inherent unbalances in each individual bridge, and the wiper of which is connected to signal ground. Thus the input signal is applied to the bridge 11 input between the INPUT and ground, that is to a pair of diagonal nodes of the bridge 11. The output of the bridge 11, connected to the bridge amplifier 25, is the other pair of diagonal nodes 30–31.

Figure 5:
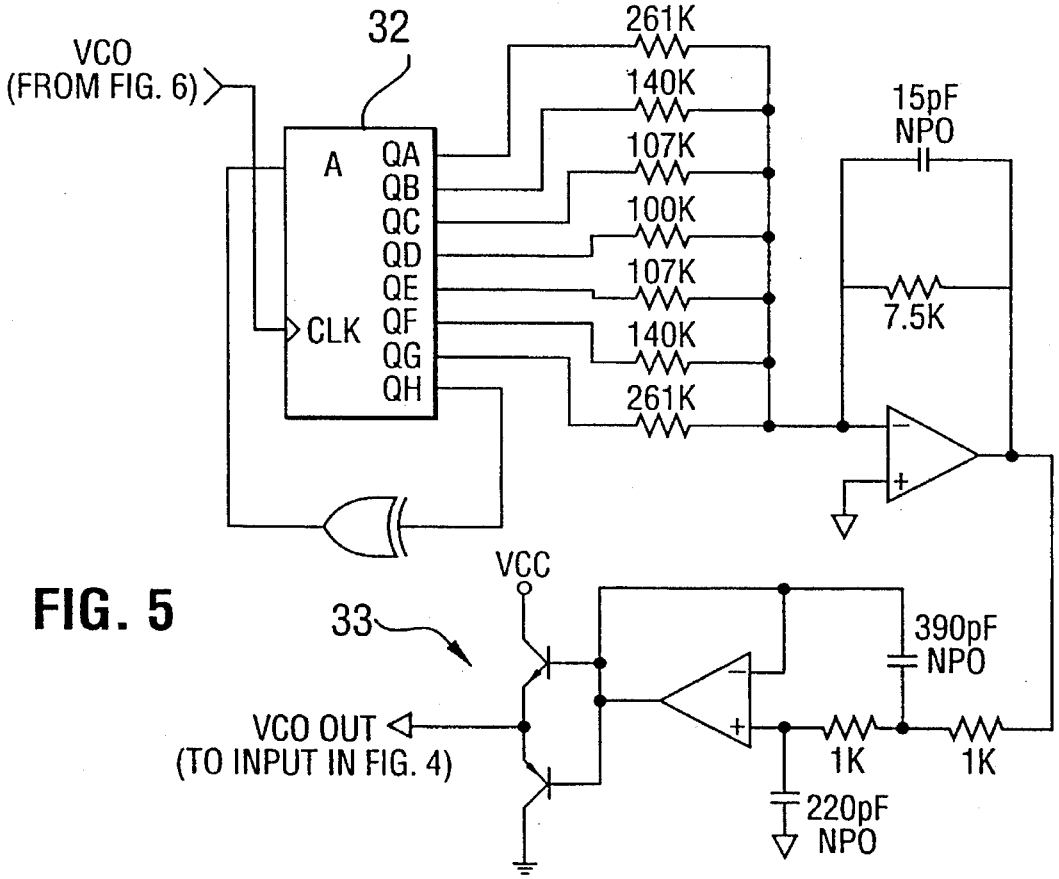
FIG. 5 is a circuit schematic of the SINE-DAC shown in FIG. 3.

FIG. 5 shows the SINE-DAC 28, which receives its input from the VCO 20 at clock input of counter 32. The counter 32 is clocked by the VCO 20 at a multiple of the output frequency (eight times in the preferred embodiment) of the buffered signal at VCO OUT, which drives the INPUT of the bridge 11 and also the phase detector 21. The VCO OUT signal, since it drives a relatively low impedance bridge, has low source impedance provided by complementary transistor pair 33. The digital-to-analog convertor comprising the counter 32 and following weighting resistors is of conventional well-known design.

Figure 6:
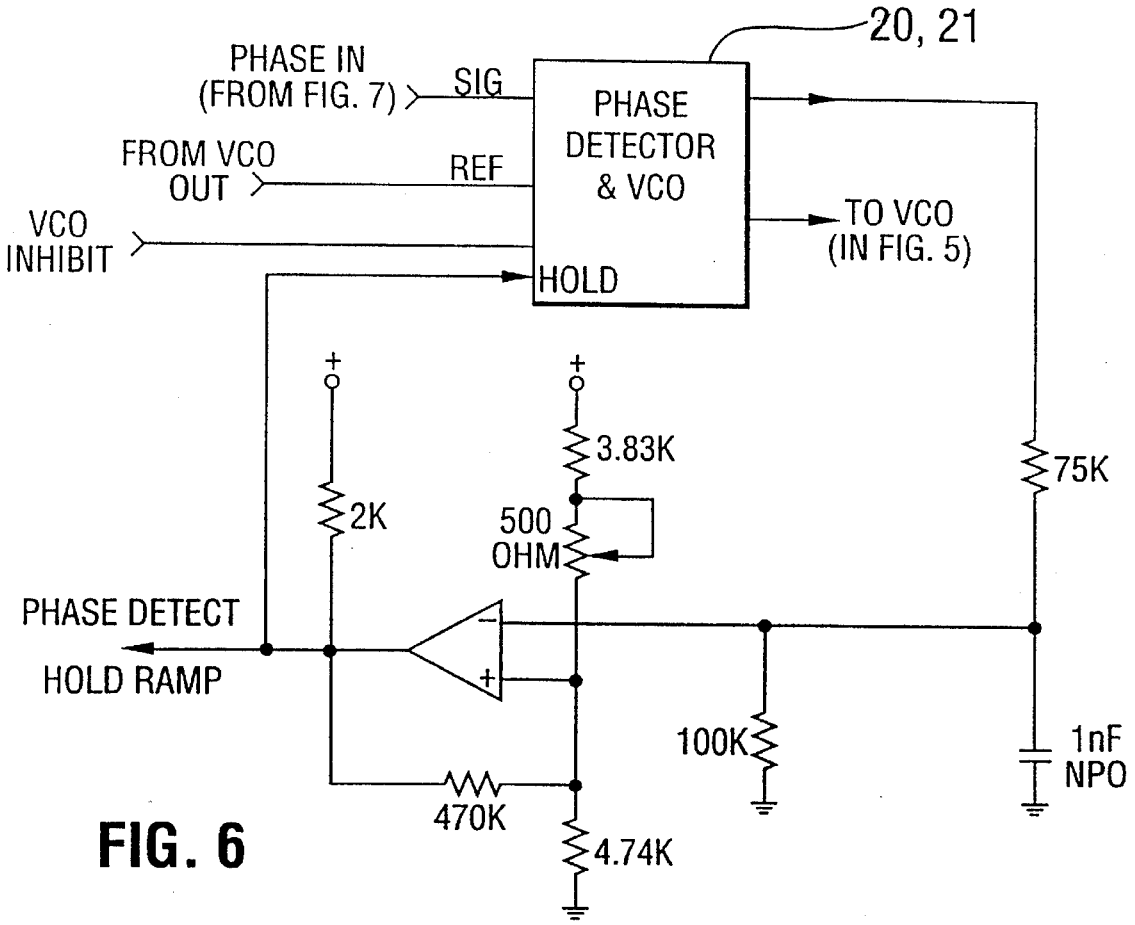
FIG. 6 is a block schematic of the VCO and phase detector shown in FIG. 3.
Figure 7:
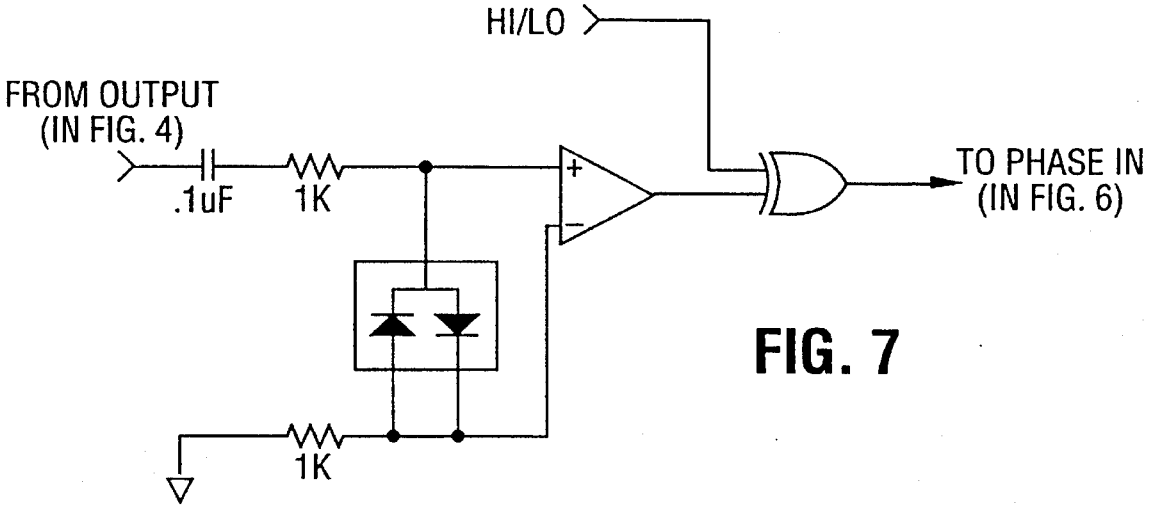
FIG. 7 is a circuit schematic of a buffer/gating circuit between the bridge amplifier and the phase detector in FIG. 3.

FIGS. 6 and 7 show the ancillary circuits of the VCO 20 and the phase detector 21, which are actually a single IC (74HC4046 by Motorola). The signal from the OUTPUT in FIG. 4 is applied via the buffering and gating circuit of FIG. 7 to signal input SIG of the phase detector 21, to the reference input REF of which is applied (also via an identical circuit as that of FIG. 7) the VCO OUT signal of the SINE-DAC 28. That is, the phase detector 21 compares the phase of the signal at the output (30–31) of the bridge 11 to the phase at its INPUT. It is, of course, clear why all intervening buffering and gating circuitry such as that in FIG. 7 must be identical in order to affect the relative phases at SIG and REF identically.

Figure 8:
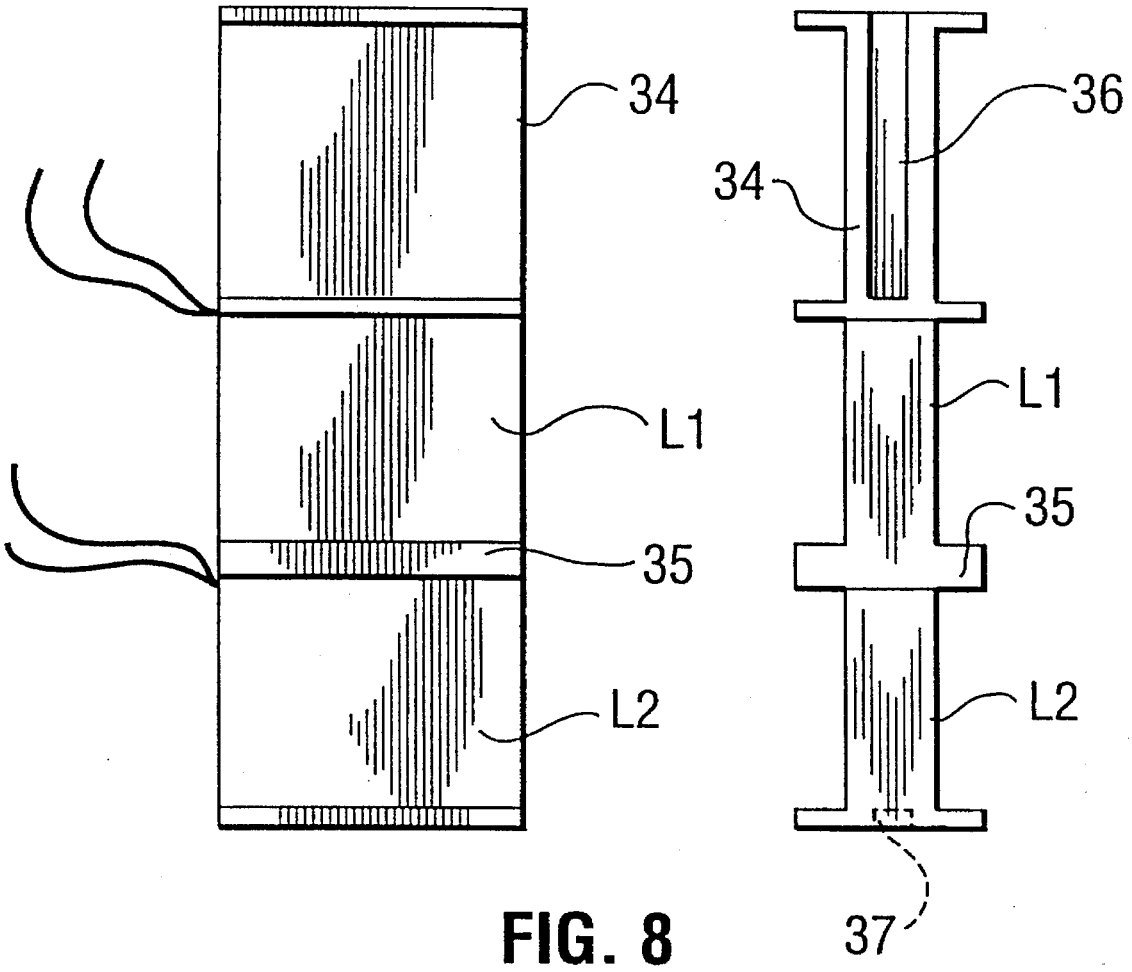
FIG. 8 is a pictorial showing two side-elevations of the bridge coils L1 and L2 shown in FIG. 4.

FIG. 8 shows the physical construction of the wire coils L1 and L2of the bridge 11. The coils L1 and L2 are identical windings, but more importantly they must have the same inductance at the frequency range of interest, that is from approximately 10 KHz to 300 KHz. Thus the inductance for each coil is 310 microhenrys plus or minus 1% measured at 250 KHz. The copper wire is #30 AWG wound in two layers having a total of approximately 160 turns per coil. The coils L1 and L2 are wound on a rectangular shaped bobbin 34 approximately 3 cm in width and 9 cm in length. Each of the windings L1 and L2 in FIG. 8 is 3 cm long and there is a small separation 35 of approximately 8 mm between the two windings. The bobbin 34 also serves as a "chute" for the coins or tokens to be descriminated and is, therefore, hollow inside having a chute of approximately 5 mm in width. A coin or token is deposited through aperture 36 and falls through the bobbin 34 to exit from its bottom aperture 37. The bobbin 34 is made from any suitable insulating material such as a plastic. While in FIG. 8 the coils L1 and L2 are shown arranged in tandem, so that the coin or token passes through both coils on its way to a collection box, this is by no means mandatory. For example, it is quite feasible to position one of the coils such that a token does not pass through it. Indeed it may be sufficient that a token merely passes in the vicinity of one of the coils such that its magnetic and/or electrical characteristics are sufficiently altered. Accordingly, it is not a requirement that the coil (L1 or L2) be wound in the manner shown in the figure. Depending on the frequency of the ac-signal applied to the bridge 11, the sensing coil (or coils) could be, in principle, a single loop of wire, the plane of which a token grazes. Moreover, if the tokens to be sensed were all non-magnetic, the coil or loop could be wound on a magnetic core or bobbin. As may be seen from the following description of the operation, it is advantageous to arrange the two coils L1 and L2 in spatial sequence such that a token first passes through L1 and then through L2, and that they be identical. But, in general, in a design where a token passes only through one coil, the second need only be identical in its electromagnetic characteristics, and could be a component having the same impedance.

OPERATION

Two parameters are determined for each coin:

a) the frequency at which the signal driving the input node of the bridge and the signal at the output node of the bridge are either exactly in phase (zero degrees) or 180 degrees out-of-phase, and b) the amplitude (which is a maximum) of the signal out of the bridge at the above frequency.

a) The Phase/Frequency Measurement

The input signal generated is a constant amplitude sine-wave signal covering the frequency range from about 200 kilohertz down to 17 kilohertz. The circuit comprises a "ramp and hold", a voltage controlled oscillator (VCO), and a sine-wave digital-to-analog convertor (SINE-DAC). The total frequency span is divided into two ranges, referred to as HI (high frequency range) and LO (low frequency range) in FIG. 3. The high range is approximately 200 kHz down to 80 kHz and the low range is approximately 60 kHz down to 15 kHz.

Referring to FIG. 3, when doing a measurement, the oscillator frequency always starts at the highest frequency for that range and sweeps 15 down to the lower limit. A typical sweep would be accomplished by first selecting the HI frequency range and selecting DOWN to sweep the oscillator frequency from the highest to lowest frequency. If the required phase relationship is not detected somewhere in the range, the ramp and hold are quickly ramped back UP to the maximum voltage, the range changed from HI to LO, and the oscillator swept DOWN once again.

A one millisecond active low pulse on the UP line will reset the ramp and hold output, VCO and SINE-DAC to the maximum output frequency for the selected range. A ten millisecond active high pulse on the DOWN line will sweep the drive frequency over the entire range selected, if detection of the required phase does not occur. The two control lines for the ramp and hold are independent of each other and only one should be asserted at a time.

As a coin enters the first coil of the chute, the bridge becomes unbalanced and an output signal is generated. This signal is amplified and converted to a logic level, as is the reference signal driving the bridge. These two logic signals are then passed to a phase angle detector capable of determining when the two inputs are either exactly in-phase or 180 degrees out-of-phase. The selection of in-phase or 180 degrees out-of-phase occurs automatically when the frequency range is selected. For the HI range, the circuit is checking for 180 degrees phase difference. For the LO range, it is checking for zero degrees phase difference.

If the appropriate phase relationship is detected, the phase detector immediately stops the ramp and hold output, which keeps the oscillator at a fixed frequency for the remainder of the measurement cycle. This action overrides the DOWN line. The intention is to very quickly "freeze" the oscillator at the correct frequency. This will prevent overshooting of the frequency while the controller (microprocessor 23) is polling the "PHASE DETECT" signal line. The ramp and hold circuit's output will remain stable for approximately 100 milliseconds after entering the hold state. The three allowed states and the control inputs are:

| Mode | UP | DOWN |
|---|---|---|
| Ramp Up | LO | LO |
| Ramp Down | HI | HI |
| Hold | HI | LO |

The frequency at which the phase detector indicates 180 degrees shift is a key indicator of material content of a coin. Mainly non-magnetic materials such as copper, aluminum, cupro-nickel, or other similar alloys, will cause such phase detection somewhere between 200 and 100 kilohertz. Objects with a significant amount of magnetic material such as nickel will cause the requisite phase detection below 30 kilohertz.

b) Amplitude Measurement

The magnitude of the signal from the bridge will be a maximum at or near the frequency determined above. As soon as the VCO is at the correct frequency, amplitude measurements can begin. The output of the bridge amplifier is converted from an ac to a dc signal, amplified further and then applied to an analog-to digital converter. The converter preferred has a serial interface to minimize the I/O required with the microprocessor. The amplitude measurements can be simply logged to memory for later analysis, or the samples may be compared with previous ones to determine the peak reading when the coin is fully within the coil.

The output of the ac-dc convertor is sensed by the threshold detector which generates the signal COIN-IN. It has been found in experiments that the phase relationship between the bridge driving signal and the output is not critically dependent upon the amplitude of the output signal, as long as it exceeds a certain minimum. Therefore, as soon as the amplitude of the signal is large enough to generate a clean logic signal into the phase detector, the frequency sweeping can begin. This minimum signal is set by the threshold detector and typically occurs when a coin is 25% to 30% into the first coil L1.

Following is the assembly language listing (with commentary) for the microprocessor 23, which is a Z80 (Zylog) in the present case.

```
ld h1,CHECK_INCOMING_DELAY
call delay

ld b,O
ld de,THRESHOLD_TIMEOUT              ;  Wait up to a minute.

threshold_wait:
bit COIN_DETECTED,(iy + IO_HIGH_REG);  check for imbalance
jp nz,skip_debounce_check            ;  if coin not on route, skip
call delay_1_msec                    ;  wait 1 mill sec for debounce
bit COIN_DETECTED,(iY + iO_HIGH_ REG);  check again for imbalance
jp z,sweep_frequency                 ;  if coin on route, next step

skip_debounce_check:
djnz threshold wait                  ;  If b != 0, test again.

call decrement_counter               ;  See if timeout has elapsed.
jp z,exit_failure                    ;  If timeout then quit.

jr nc,threshold_wait                 ;  not time for watchdog, loop;

call reset_watchdog                  ;  kick dog so we don't die !!
jp threshold_wait                    ;  loop

; -------- sweep setup and find range ----------------------------------------------------
```

```
sweep_frequency:
ld hl,START_SWEEP_DELAY
call delay

call read_adc                          ; dummy read, clear garbage

ld b,NUM_CHECKS_TO_MAKE                ; reload the counter

first_coil_peak:
call read_adc
ld (ix + ADC_STATIC_VALUE),a
ld h1,FREQ_SWEEP_DELAY
call delay
call read_adc
ld (ix + ADC_SAVED_VALUE),a

first_coil_loop:
dec b
jp z,exit_failure                      ; are we done?
; ld hl,FREQ_SWEEP_DELAY
call small_delay
call read_adc                          ; here's where we peak detect
ld e,a                                 ; intermediate save
sub (ix + ADC_SAVED_VALUE)             ; compare with last sample
jp z,skip_this_one
jp nc,shift_numbers

skip_this_one:
ld a,(ix + ADC_SAVED_VALUE)
sub (ix + ADC_STATIC_VALUE)
jp z,do_the_sweeps
jp nc,shift_numbers
jp do_the_sweeps

shift_numbers:
ld a,(ix + ADC_SAVED_VALUE)
ld (ix + ADC_STATIC_VALUE),a
ld (ix + ADC_SAVED_VALUE),e
jp first_coil_loop

do_the_sweeps:
ld a,SWEEP_LO_FLAG_VALUE               ; set sweep flag to 0
res HI_LO_SELECT,(iy + IO_HIGH_REG); select low freq. sweep
call sweep_range                       ; do the sweep
jp z,measure_amplitude                 ; if phase detected, next step

ld a,SWEEP_HI_FLAG_VALUE               ; change sweep flag value
set HI_LO_SELECT,(iy + IO_HIGH_REG); select high frequency sweep
```

```
call sweep_range                ; do the sweep
jp z,measure_amplitude          ; if phase detected, next step

jp exit_failure                 ; we didn't find the range!

;---------analogtodigitalmeasurements-----------------------------------------------

measure_amplitude:

ld b,NUM_CHECKS_FOR_NULL

; This routine will wait for the intercoil null, and then peak detect for
; the remaining samples

wait_for_null:

dec b
jp z,exit_failure               ; never got the null
call read_adc                   ; first value for checking
ld e,a                          ; intermediate save
sub ADC_NULL_VALUE              ; test for null value
jp c,measure_peak               ; null, go to measure
jp wait_for_null                ; otherwise, wait for it.

measure_peak:

ld b,NUM_CHECKS_TO_MAKE         ; reload the counter

peaked:

dec b
jp z,measure_done               ; are we done?
call read_adc                   ; here's where we peak detect
ld e,a                          ; intermediate save
sub (ix + ADC_SAVED_VALUE)      ; compare with last sample
jp c,peaked                     ; if its smaller, try again
ld (ix + ADC_SAVED_VALUE),e     ; otherwise, keep it
jp peaked                       ; Go around again

measure_done:
ld (ix + ADC_STATIC_VALUE),0    ; cleanup from usage

;--------- setup, call and cleanup for vco frequency measurement ----------------

measure_frequency:
ld de, EMPTY_COIL_OFFSET
add ix,de                       ;  point to empty coil storage
```

```
push ix
pop hl
ld (iy + EDGE_CTRL_REG),EDGE_DETECT_OFF; setup FPC, do not enable
ld a,(ix + SWEEP_FLAG)              ; load sweep range indicator
or 0                                ; test for low range
jp z,low_setup                      ; zero, vco in low range

high_setup:
ld (iy+FPC_CTRL_REG),FPC_SETUP_HI; setup FPC to conversion mode
jp now_setup                        ; skip vco low range setup

low_setup:
ld (iy+FPC_CTRL_REG),FPC_SETUP_LO; setup FPC to conversion mode

now_setup:
ld (iy + EDGE_CTRL_REG),EDGE_DETECT_SETUP_2; enable edge detectors
set TIMER_OVFL,(iy + COIN_CTRL_REG)
set OUT_CMP,(iy + COIN_CTRL REG)
ld e,(iy + TIMER_CAPTURE_REG_LO) ; clear OCI just
ld d,(iy + TIMER_CAPTURE_REG_HI) ; in case one is pending
ld a,FPC_MASK                       ; set mask value
set FPC_START,(iy + FPC_CTRL_REG); start FPC
call get_empty_coil                 ; measure the frequency
res FPC_START,(iy + FPC_CTRL_REG); stop FPC
res TIMER_OVFL,(iy + COIN_CTRL_REG)
res OUT_CMP,(iy + COIN_CTRL_REG)
jr nc,exit_failure

exit_success:

; Measure the quiescient amplitude and subtract from the peak to adjust for
; the null

ld hl,10
call delay
call read_adc
call read_adc
ld e,a
ld a,(ix + ADC_SAVED_VALUE)
sub e
ld (ix + ADC_SAVED_VALUE),a
ld bc,COIN_SUCCESS
jr exit

exit_failure:
ld bc,COIN_FAILURE
jr exit
```

```
exit_coin_absent:
ld bc,COIN ABSENT

exit:
set COIN DETECT_ENABLE,(iy + COIN_CTRL_REG);turn on proximity
detector
pop iy
pop ix
pop hl
ret

;---------sweep, 'a' is hi/low range flag----------------------------------------------

sweep_range:
ld (ix + SWEEP_FLAG),a                  ; save range indicator for ADC
res SWEEP_UP_FREQ,(iy + IO_LOW_REG);  init sweep frequency
ld hl,RESET_SWEEP_TIME                  ; set VCO at upper freq
call delay                              ; takes 1 msec
set SWEEP_UP_FREQ,(iy + IO_LOW_REG);  ok we are at top
set SWEEP_DOWN_FREQ,(iy + IO_LOW_REG);  start sweep
ld a,(ix + SWEEP_FLAG)                  ; low freq, or high?
sub 1
jp c,low_sweep_delay
ld hl,SWEEP_DELAY_HI                    ; high ramp delay
jp execute_the_delay

low_sweep_delay:
ld hl,SWEEP_DELAY_LO                    ; low ramp delay

execute_the_delay:
call delay                              ; do the delay
bit PHASE_DETECTED,(iy + IO LOW_REG);  check for phase
res SWEEP_DOWN_FREQ,(iy + IO_LOW_REG);  turn off sweeping
ret

;--------retrieve adc value----------------------------------------------------------

read_adc:
push bc
res AD_ENABLE,(iy + IO_HIGH_REG)  ; enable A/D convertor
ld a,0                            ; initialize result to 0
ld b,8                            ; do 8 bits, 8..1

net_bit:
rlca                              ; shift result left
bit AD_DATA,(iy + IO_HIGH_REG)    ; test data bit
jp z,skip_set_bit                 ; not set, skip setting result
set 0,a                           ; set bit zero
```

```
skip_set_bit:
set AD_CLOCK,(iy + IO_HIGH_REG)  ;  raise clock
res AD_CLOCK,(iy + IO_HIGH_REG)  ;  lower clock
djnz next_bit
set AD_ENABLE,(iy + IO_HIGH_REG) ;  disable A/D convertor
pop bc
ret

;--------get vco frequency reading----------------------------------------------------------

get_empty_coil:
ld d,a                           ;  Put mask in d.
ld c,0                           ;  Keep track of edge history.
exx                              ;  go to alternate register set
ld b,0                           ;  MSB always zero
ld c,0                           ;  Keep track of timer overflow.
ld hl, 0                         ;  # of mass readings initialized to 0
exx                              ;  go back to regular register set
jr gec_wait_for_edge

gec_test_for_timeout:
res TIMER_OVFL,(iy + COIN_CTRL_REG);  Reset overflow bit.
set TIMER_OVFL,(iy + COIN_CTRL_REG);  Re-enable overflow bit
ld a,MAX_ROLLOVER
exx                              ;   go to alternate register set
inc c
cp c                             ;  Did we timeout?
exx                              ;  back to regular register set
jp z,gec_edge_timeout            ;  Yes we timed out, exit.

gec_wait_for edge:
bit TIMER_OVFL_INT,(iy + COIN_STATUS_REG); Did overflow occur?
jr nz,gec_test_for_timeout
bit OUT_CMP_INT,(iy + COIN_STATUS_REG);  Did edge occur?
jr z,gec_wait_for_edge           ;  No, wait some more.

bit TIMER_OVFL_STAT,(iy + COIN_STATUS_REG) ; If TOFS set, then test
jr z,gec_store_edge_count        ;  TOFI. If it is set we

bit TIMER_OVFL_INT,(iy + COIN_STATUS_REG) ; must increment overflow
jr z,gec_store_edge_count        ;  count and reset overflow.
exx
inc c                            ;  increment overflow count
exx
res TIMER_OVFL,(iy + COIN_CTRL_REG);  Reset overflow bit.
set TIMER_OVFL,(iy + COIN_CTRL_REG);  Re-enable overflow bit.
```

```
gec_store_edge_count:
exx
ld e,(iy + TIMER_CAPTURE_REG_LO) ; Get the output compare data
ld d,(iy + TIMER_CAPTURE_REG_HI) ; This register removes OCI
exx
ld a,(iy + EDGE_STATUS_REG)      ; Get the current edge status.
or c                             ; We only want new channels!!!!
xor c                            ; Get new edges
and d                            ; Mask off ones we don't want.
ld e,a                           ; The new channel edges.

gec_look_for_channel_0_edge:
bit 7,e                          ; New first edge for channel 0 ?
call nz,coil_edge_0              ; Yes, store it as first edge.
bit 6,e                          ; New last edge for channel 0 ?
call nz,coil_edge_0              ; Yes, store it as second edge.

gec_update_edge_records:
ld a,e                           ; These are new edges recorded.
or c                             ; Include old edges to new ones.
ld c,a                           ; Save this new edge record.
cp d                             ; Get all the edges we wanted ?
jp nz,gec_wait_for_edge          ; No, go back and wait for more.
scf                              ; Success !!
ret

gec_edge_timeout:
xor a
ret

;-----------------------------------------------------------------------------------------------------

coil_edge_0:
push de
push bc
push ix
push hl                          ; load ix with value in hl
pop ix
exx                              ; go to alternate register set
ld (ix + 3),b                    ; write values to storage area
ld (ix + 2),c
ld (ix + 1),d
ld (i + 0),e
inc hl                           ; increment number of mass
                                   readings taken;
exx                              ; return regular register set
ld de,4                          ; increment hl point to next mass
                                   reading
```

```
add hl, de
res 7,(iy + EDGE_CTRL_REG)        ; Reset channel 0.
set 7,(iy + EDGE_CTRL_REG)
xor a                             ; Clear carry. Good reading
pop ix
pop bc
pop de
ret

;--------timing routines----------------------------------------------------------

decrement_counter:
dec de                            ; Decrement the counter.
ld a,d
or e                              ; Check if it has reached zero.
ret z                             ; If it has, return with zero flag set.
xor a                             ; Clear the carry flag.
ld a,e                            ; Get LSB of counter.
and DECREMENT_TIMEOUT             ; Check for mod
                                    DECREMENT_TIMEOUT
ret nz                            ; If not mod
                                    DECREMENT_TIMEOUT return.
or 1                              ; Make sure zero flag is clear.
scf                               ; Set the carry flag and then return.
ret


;------------------------------------------------------------------------------------

delay_1_msec:
ld b,0

delay_loop:
djnz delay_loop
ret

; This is a 500 uS delay
small_delay:
ld b,90
smaller:
nop
dec b
jr nz,smaller
ret

;--------temporary storage variables----------------------------------------------
```

```
test_value:
defs 1

;--------end of module----------------------------------------------------------------------
end                                    ;  for assembler
```

A narrative summary of the above code listing is as follows.

CHECK FOR PRESENCE OF COIN

When "coin-detected" bit is set, a coin has caused sufficient unbalance in the bridge which caused phase detection to occur. If the bit is set, we de-bounce for 1ms and check again to ensure that signal is true. If still true we jump to the "sweep-frequency" function. If not true or set, we will wait up to 60 seconds for the coin to appear before exiting with a failure status.

SWEEP BRIDGE FREQUENCY TO FIND PHASE LOCK AND FREQUENCY RANGE

A coin is on the way. Bridge oscillator is fixed at top of low frequency range or about 70 KHz. Delay or wait at least 10ms. For repeatability of results do not start sweep until the coin has fully entered the first coil. Use successive analog-to-digital convertor measurements to determine that you have reached a peak, then let the sweeping begin. Use 1 ms delays between each ADC measurement. Once initiated, there will be at least one or at most two frequency sweeps. The low range frequency sweep is done first, followed if necessary by the high range frequency sweep. Each frequency sweep takes about 3ms to ramp the VCO from the top to the bottom of its frequency range. The hardware will automatically lock and hold the VCO if phase coincidence is achieved during any sweep. At the end of each sweep time, the "phase detected" bit is tested and if true the routine is terminated successfully. If phase is not detected after the first sweep, the second sweep is initiated. If phase is not detected after the second sweep, the routine is terminated with a failure, because ALL coins must cause a phase coincidence in at least one of the two sweeps. When we finish here we either failed to achieve phase coincidence (this should never happen) or we know that we did get phase coincidence and in which frequency range it occurred. Because the VCO frequency can be held for over 100 ms without a drifting error occurring, we will measure the frequency at our leisure after the coin has passed out the bottom of the chute.

MEASURE THE PARK AMPLITUDE CAUSED BY THE COIN IN COIL L2

The coin is currently exiting the first coil of the bridge. The bridge frequency is now at the same frequency at which phase coincidence occurred. The ADC is used again, and the values acquired can either be temporarily stored in RAM for later comparison or an immediate comparison of the successive measurements can be done. Successive measurements will also allow us to detect the null or low voltage point when the coin is perfectly centered between the two coils and the bridge is momentarily balanced again. This reference point may be useful to further characterise the coin in the future. When the peak value has been determined, the function exits successfully.

MEASURE THE FREQUENCY

The coin has exited the chute. VCO remains locked at a fixed, as yet unknown frequency. The output of the VCO is connected to the input of a high speed digital counter, which is referenced to a still higher frequency clock. The VCO signal is divided down, and the resulting lower frequency signal is fed into an edge detect circuit which is triggered by each falling or rising edge of the input signal. The triggered pulses cause the contents of a high speed 16 bit counter to be latched and saved. An 8 bit overflow register is also saved. The contents of the counter and register are representative of the period of the divided down VCO signal.

MEASURE THE QUIESCENT AMPLITUDE

There is a certain amount of noise associated with each meter circuit, and not all meter are alike. To compensate for this error, a measurement of the quiescent state of the bridge with no coin present is taken and that value then subtracted from the peak value determined when the coin passed through the second coil.

In the present preferred embodiment, the frequency of the signal applied to the bridge 11 is swept in two ranges: first from 70 KHz down to 17 KHz; and second from 200 KHz to 80 KHz. This is done for the sake of design convenience, due to the fact that non-magnetic coins are best detected looking for the bridge unbalance maximum at the 180 degree phase-shift points while magnetic coins are more effectively detected looking for the maximum at the zero degree phase-shift point.

It has been found that the 180 degree phase shift for most magnetic coins would occur at relatively higher frequencies, typically between 200and 400 KHz. This is not preferred, since the circuitry becomes more complicated and the natural resonance of the coils comes into play at the higher frequencies, influencing the measurement. This difficulty is avoided by noting that the special phase relationship in effect "wraps around" and is reversed in the very low frequency range. Thus, for magnetic coins, the circuitry looks for zero degrees phase difference when searching the low frequency range.

This turns out to be advantageous, since the maximum amplitude of 15 bridge deflection is larger at low frequencies for magnetic coins. This is because the change in the impedance of the coil is due to the high permeability of the coins, which has a significant effect on the inductance at low frequencies.

The non-magnetic coins, on the other hand, cause the coil impedance to change based on eddy current effects, and these effects are at their maximum in the higher frequency range. When all this information is put together, the advantageous result is that non-magnetic coins exhibit maximum amplitude and 180 degrees phase shift in the 90 to 180 KHz range, while magnetic coins exhibit maximum amplitude and zero degrees phase shift in the 15 to 30 KHz range.

The embodiments of the invention in which an exclusive property of privilege is claimed are defined as follows:

1. An apparatus for detecting the presence and identity of coins/tokens, comprising:

a bridge including two inductors of equal value and two impedances of equal value, one in each arm of said bridge, said bridge having a pair of input nodes and a pair of output nodes, said bridge producing a normally balanced output signal in the absence of coins/tokens in the vicinity of said bridge and an unbalanced signal in the presence of coins/tokens;

signal generating means for applying a sequence of signals of different predetermined frequencies to said input nodes;

phase detection means for receiving said input and output signals and detecting a predetermined phase shift between said input and output signals; and amplitude detection means for producing a "coin in" signal when said output signal exceeds a predetermined threshold;

means for detecting at least two parameters of said bridge when said phase detection means detects said predetermined phase shift and comparing said parameters with corresponding predetermined parameters of known coins/tokens and identifying the coin/token when a match is detected.

2. An apparatus for detecting the presence and identity of coins/tokens as defined in claim 1, said phase detection means being operable to control the frequency of said signal generating means until said predetermined phase shift has been detected.

3. An apparatus for detecting the presence and identity of coins/tokens as defined in claim 1, said phase detection means being operable to control the frequency of said signal generating means until said predetermined phase shift is either 180 degrees or zero degrees.

4. An apparatus for detecting the presence and identity of coins/tokens as defined in claim 1, said signal generating means being operable to apply a continuously variable frequency between predetermined upper and lower frequencies across the input of said bridge.

5. An apparatus for detecting the presence and identity of coins/tokens as defined in claim 4, said signal generating means being operable to repeat said continuously variable frequency signal until a predetermined output is detected.

6. An apparatus for detecting the presence and identity of coins/tokens as defined in claim 1, said signal processing means including a voltage controlled oscillator for producing said signals of different predetermined frequencies and means for applying an oscillator input signal to said oscillator to cause said oscillator to output said signals of different predetermined frequencies.

7. An apparatus for detecting the presence and identity of coins/tokens as defined in claim 6, wherein said different frequencies range from about 15 to about 250 kHz.

8. An apparatus as defined in claim 1, further including a bridge amplifier for receiving the output of said bridge and applying an amplified output signal to said detector.

9. An apparatus as defined in claim 8, further including a rectifier for receiving said output signal and producing a rectified output signal and an analog-to-digital converter for producing a digitized output signal.

10. An apparatus as defined in claim 1, further including processor means for receiving said amplitude output signal and said phase detection signal and associating said output signals with predetermined signal combinations representative of predetermined coins/tokens.

11. An apparatus for detecting and identifying the denomination of coins and tokens, said apparatus comprising:

a coin chute having a passageway for receiving coins and tokens;

an ac-bridge operable for producing a bridge output signal in response to a bridge input signal, said ac-bridge including two inductors of equal value and two impedances of equal value, one in each arm of the bridge, said inductors being wound about said coin chute;

a controller;

means for applying a bridge input signal to said bridge including:

a ramp and hold circuit for producing an oscillator control signal, said circuit being responsive to circuit control signals for increasing or decreasing said oscillator control signal;

a voltage controlled oscillator responsive to said oscillator control signal for producing an oscillator output signal;

a digital-to-analog converter for receiving said oscillator output signal and producing an ac signal and applying said signal to said ac-bridge;

a bridge amplifier for receiving said bridge output signal and producing an amplified bridge output signal;

phase shift detecting means for detecting a predetermined phase shift between said bridge input signal and said bridge output signal and transmitting a phase shift detected signal to said controller upon detection of said predetermined phase shift, said controller being responsive to said phase shift detected signal by causing said ramp and hold circuit to hold its output constant to cause the frequency of said bridge input signal to remain constant and measuring the frequency of said bridge input signal;

amplitude detection means for receiving said amplified bridge output signal and producing a "coin-in" signal when the amplitude of said signal exceeds a predetermined threshold value and for producing digitized magnitude output signals, said controller being responsive to said "coin-in" signal by generating said circuit control signals and being further responsive to phase shift detected signal by accepting said digitized magnitude output signals and determining a peak magnitude output signal, comparing the frequency of said bridge input signal and said peak magnitude output signal against corresponding predetermined signals representative of predetermined coins.

12. An apparatus for detecting and identifying the denomination of coins and tokens as defined in claim 11, said amplitude detection means including:

an AC-DC converter for converting said amplified bridge output signal to a DC signal;

a threshold detector for receiving said DC signal and producing said "coin- in" signal; and an analog-to-digital converter responsive to an enable signal from said controller for digitizing said DC signal and transmitting digitized DC signals to said controller.

13. A method of detecting and identifying metallic coins and tokens, comprising:

applying an ac input signal to the ac-bridge when a coin/token is detected in the vicinity of an arm of an ac-bridge;

sweeping the frequency of said ac signal through a predetermined frequency range while the coin/token is in the vicinity of one arm of the ac-bridge;

monitoring the bridge output signal and associating a signal which exceeds a predetermined threshold level with the presence of a coin/token;

monitoring the phase difference between the ac input signal and the bridge output signal;

determining the frequency of the input signal at which the phase difference reaches a predetermined value;

determining the peak magnitude of the bridge output signal; and comparing the determined frequency and peak magnitude signals with the frequency and peak magnitude signals of known coins and identifying the coin/token when a match exists.

14. A method of detecting and identifying the denomination of coins/tokens as defined in claim 13, further including the step of monitoring the output of the ac-bridge for a signal exceeding a predetermined threshold level prior to applying said ac signal.

* * * * *